US012285054B1

(12) United States Patent
Wang et al.

(10) Patent No.: US 12,285,054 B1
(45) Date of Patent: Apr. 29, 2025

(54) ATOMIZATION DEVICE HAVING GAS PASSAGE WITH BREATH DETECTOR ISOLATED FROM ATOMIZATION CHANNEL

(71) Applicant: Shenzhen Woody Vapes Technology Co., Ltd., Guangdong (CN)

(72) Inventors: Hui Wang, Guangdong (CN); Lijun Chen, Guangdong (CN)

(73) Assignee: Shenzhen Woody Vapes Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/882,815

(22) Filed: Sep. 12, 2024

(30) Foreign Application Priority Data

Jan. 26, 2024 (CN) ..... 202420218191.8

(51) Int. Cl.

| | |
|---|---|
| ***A24F 40/51*** | (2020.01) |
| ***A24F 40/10*** | (2020.01) |
| ***A24F 40/44*** | (2020.01) |
| ***A24F 40/485*** | (2020.01) |
| ***A24F 40/95*** | (2020.01) |
| *A24F 40/46* | (2020.01) |

(52) U.S. Cl.
CPC ..... *A24F 40/51* (2020.01); *A24F 40/10* (2020.01); *A24F 40/44* (2020.01); *A24F 40/485* (2020.01); *A24F 40/95* (2020.01); *A24F 40/46* (2020.01)

(58) Field of Classification Search
CPC ..... A24F 40/51; A24F 40/485; A24F 40/95; A24F 40/10
See application file for complete search history.

(56) References Cited

U.S. PATENT DOCUMENTS

| | | | | |
|---|---|---|---|---|
| 11,992,045 | B2 * | 5/2024 | Qiu | A24F 40/10 |
| 2022/0248503 | A1 * | 8/2022 | Mironov | A24F 40/53 |
| 2023/0354904 | A1 * | 11/2023 | Shen | A24F 40/485 |
| 2024/0074497 | A1 * | 3/2024 | Wang | A24F 40/40 |

FOREIGN PATENT DOCUMENTS

| | | | |
|---|---|---|---|
| CN | 116711884 A | * | 9/2023 |
| CN | 220403091 U | * | 1/2024 |

* cited by examiner

*Primary Examiner* — Hae Moon Hyeon

(57) ABSTRACT

An atomization device includes a housing, an oil storage tank provided within the housing to store oil, and a breath detector provided within the housing. The housing includes a suction part for suction by a user and a mist outlet pipeline provided in the suction part. The mist outlet pipeline has a mist outlet port exposed on a surface of the suction part. An atomization channel is formed within the oil storage tank and has a mist outlet end connected with a mist inlet end of the mist outlet pipeline. A first gas passage connected with the breath detector is formed within the housing. The suction part is provided with a first gas hole connected with the first gas passage. Each of the atomization channel, the oil storage tank and the mist outlet pipeline is isolated from the first gas passage.

16 Claims, 6 Drawing Sheets

ATOMIZATION DEVICE HAVING GAS PASSAGE WITH BREATH DETECTOR ISOLATED FROM ATOMIZATION CHANNEL

RELATED APPLICATIONS

This application is a Paris Convention which claims the benefit of priority of Chinese Patent Application No. 202420218191.8, filed on Jan. 26, 2024. The contents of the above application is all incorporated by reference as if fully set forth herein in its entirety.

FIELD AND BACKGROUND OF THE INVENTION

The present disclosure relates to atomization technologies, and in particular relates to an atomization device.

An atomization device is used for supplying mist to a user. However, many atomization devices do not actively output a certain amount of mist to the outside. It requires a user's suction to generate gas flow in the atomization channel, and at the same time the atomization core in the atomization channel starts to heat the oil to be atomized, so that the atomized oil is mixed with the gas flow in the atomization channel to form the mist. Finally, the mist enters the user's mouth through a mist outlet pipeline for use by the user. Thus, whether there is gas flow in the atomization channel depends on whether the user is suctioning the atomization device.

If the user is not suctioning the atomization device while the atomization core always operates to heat the oil, the atomized oil cannot flow out of the atomization device along with the gas flow and will accumulate in the atomization device. The accumulated oil may finally condense into liquid oil and flow into another part of the atomization device to cause leakage, which is not desired.

In order to determine whether the user is suctioning atomization device, it is possible to adopt a breath detector which can detect the gas flow in the atomization channel. When the gas flow in the atomization channel is greater than zero, the breath detector can send a signal to the control component of the atomization device which then can control the atomization core to heat and atomize the oil. In order to enable the breath detector to detect the gas flow in the atomization channel, the gas passage of breath detector is usually directly connected with the atomization channel or the mist outlet pipeline. In this way, when there is gas flow in the atomization channel or the mist outlet pipeline, a gas flow will be generated in the gas passage for the breath detector and can be detected by the breath detector to reflect the gas flow in the atomization channel.

However, since the gas passage for the breath detector is connected with the atomization channel or the mist outlet pipeline, the mist in the atomization channel or the mist outlet pipeline is likely to flow reversely along the gas passage for the breath detector and eventually contact the breath detector and condense on the surface of the breath detector to form oil droplets that may cause damage to the breath detector. Thus, there is a need for an atomization device capable of protecting the breath detector from damage caused by the oil droplets.

SUMMARY OF THE INVENTION

According to one or more embodiments of the present disclosure, an atomization device includes a housing, an oil storage tank provided within the housing to store oil, and a breath detector provided within the housing. The housing includes a suction part for suction by a user and a mist outlet pipeline provided in the suction part. The mist outlet pipeline has a mist outlet port exposed on a surface of the suction part. An atomization channel is formed within the oil storage tank and has a mist outlet end connected with a mist inlet end of the mist outlet pipeline. A first gas passage connected with the breath detector is formed within the housing. The suction part is provided with a first gas hole having an end exposed on the surface of the suction part and an other end connected with the first gas passage. Each of the atomization channel, the oil storage tank and the mist outlet pipeline is isolated from the first gas passage.

BRIEF DESCRIPTION OF THE SEVERAL VIEWS OF THE DRAWING(S)

Figure 6:
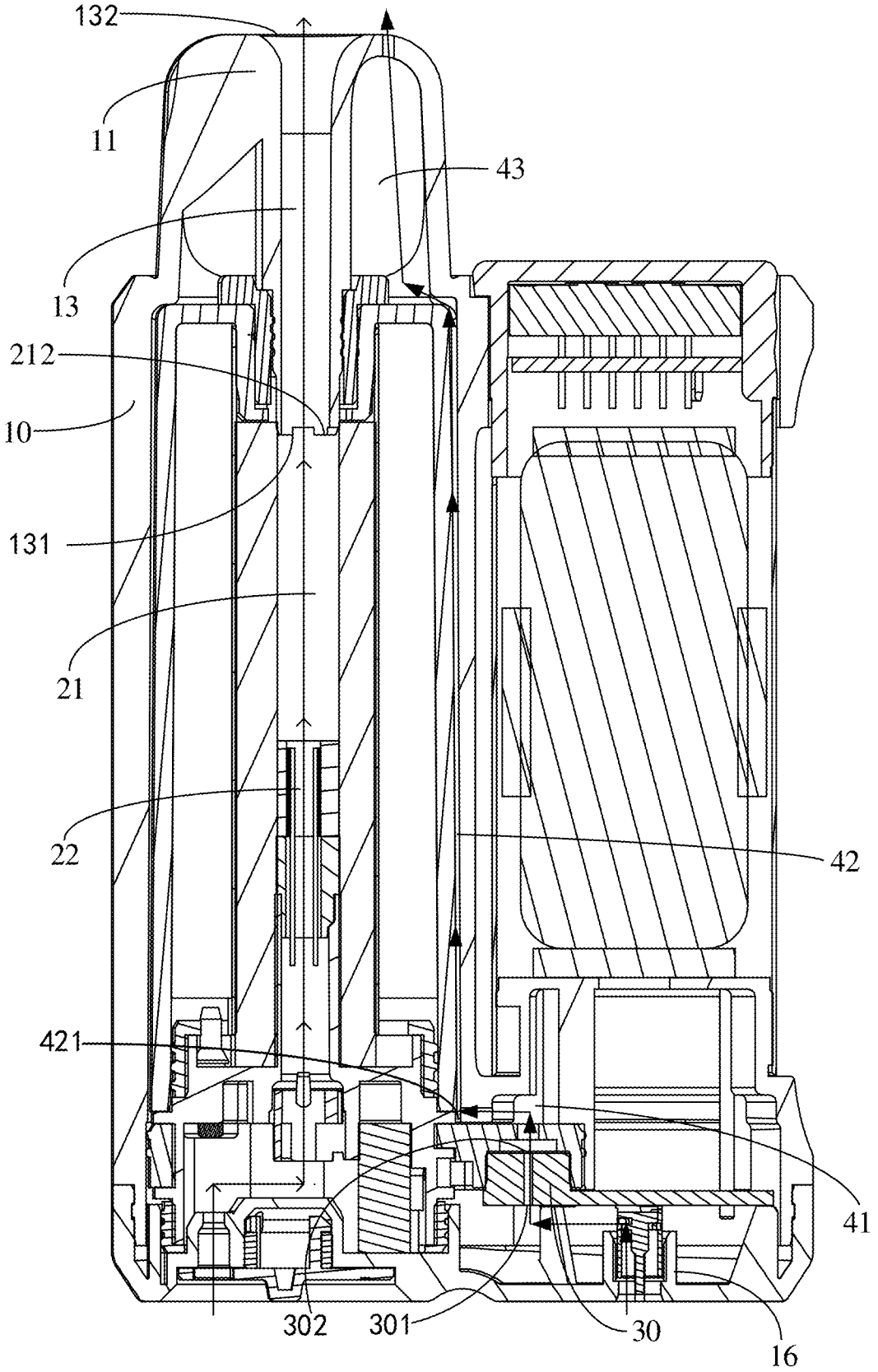

FIG. 6 schematically illustrates a direction of a gas flow in an atomization device according to one or more embodiments of the present disclosure.

List of reference signs:

| Reference sign | Name |
|---|---|
| 10 | Housing |
| 11 | Suction part |
| 12 | First gas hole |
| 13 | Mist outlet pipeline |
| 14 | Atomization chamber |
| 15 | Battery chamber |
| 16 | Charging socket |
| 17 | Second gas hole |
| 18 | Through groove |
| 20 | Oil storage tank |
| 21 | Atomization channel |
| 22 | Atomization core |
| 30 | Breath detector |
| 41 | Upstream gas passage |
| 42 | Midstream gas passage |
| 43 | Downstream gas passage |
| 50 | First seal |
| 51 | Second through hole |
| 60 | Mounting wall |
| 61 | First through hole |
| 70 | Second seal |
| 80 | Battery |
| 90 | Third seal |

DESCRIPTION OF SPECIFIC EMBODIMENTS OF THE INVENTION

Some embodiments of the present disclosure will be described in detail below with reference to the accompanying drawings. The embodiments are described for illustrative purposes only and are not intended to limit the present disclosure.

According to one or more embodiments of the present disclosure, an atomization device is provided to solve a problem of poor protection effect of a general atomization device for a breath detector. The following description will be made in conjunction with the drawings.

Figure 1:
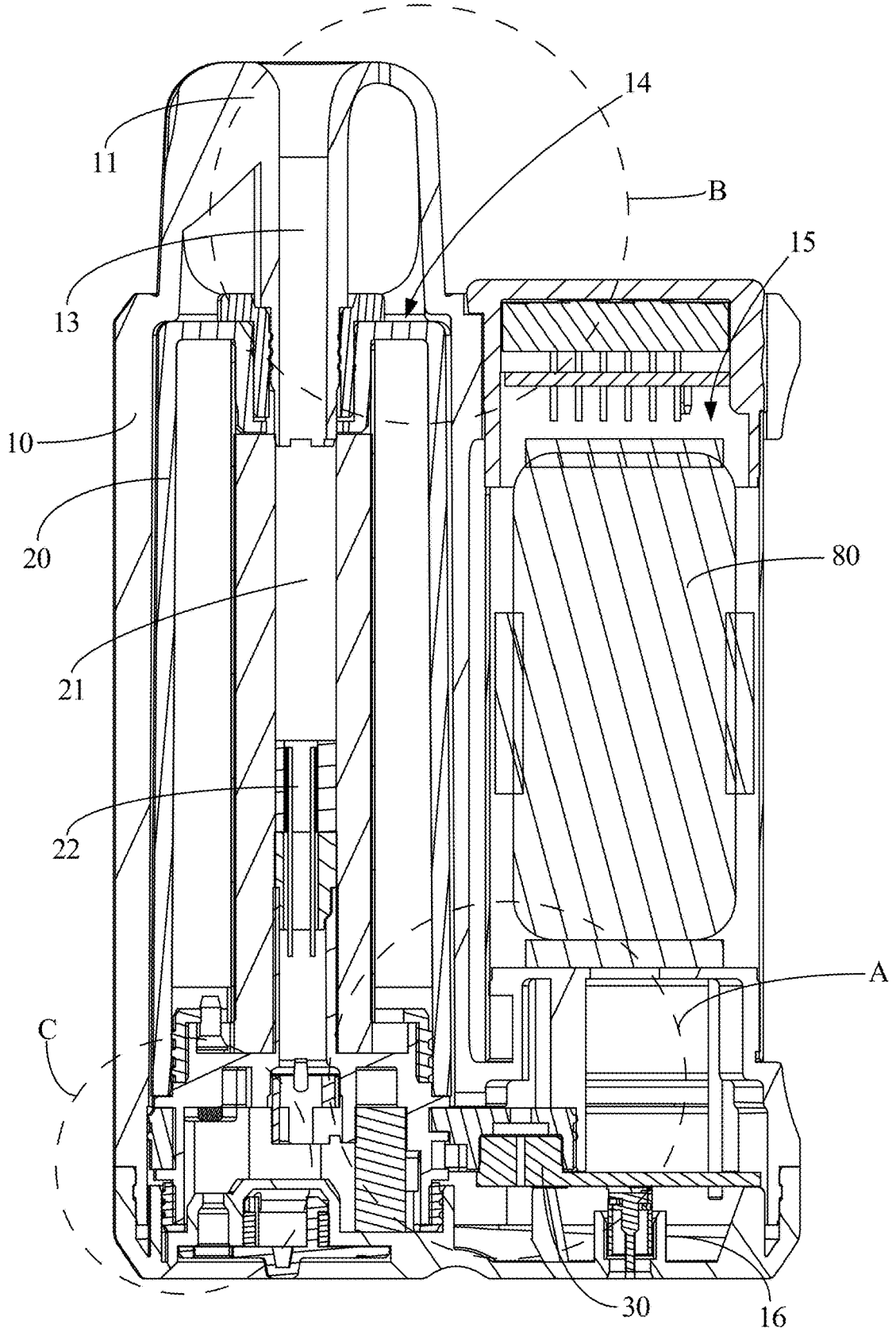
FIG. 1 is a schematic cross-sectional view of an atomization device according to one or more embodiments of the present disclosure.

Referring to FIGS. 1 and 6, according to one or more embodiments of the present disclosure, an atomization device includes a housing 10, an oil storage tank 20, and a breath detector 30. The housing 10 includes a suction part 11 and a mist outlet pipeline 13. The suction part 11 is used for suction by a user. Therefore, the suction part 11 may be formed as a shape of a mouthpiece as shown in FIG. 1, or may be formed as a shape of a cylinder or the like to facilitate suction by the user. The mist outlet pipeline 13 is provided in the suction part 11, and the mist outlet port 132 of the mist outlet pipeline 13 is exposed on the surface of the suction part 11, so that when the user keeps the suction part 11 in the mouth for suction, the mist outlet port is connected to the oral cavity of the user to be subjected to negative pressure in the oral cavity, thereby forming gas flow in the mist outlet pipeline 13. An atomization channel 21 is formed in the oil storage tank, and since the mist outlet end 212 of the atomization channel 21 is connected to the mist inlet end 131 of the mist outlet pipeline 13, the gas flow in the mist outlet pipeline 13 can drive the gas in the atomization channel 21 to form gas flow, thereby establishing continuous gas flow from the atomization channel 21 to the oral cavity of the user. In this case, it is only necessary to control the atomization core 22 to heat the oil, so that the mist containing the oil mist can be supplied to the user. The oil to be atomized is stored in the oil storage tank 20, and the atomization channel 21 is formed in the oil storage tank 20, so that the oil in the oil storage tank can be conveniently supplied to the atomization core 22. In general, the oil storage tank 20 may be connected to the atomization core 22 by the oil guide cotton, so that the oil is subjected to capillary action in the oil guide cotton and continuously flows toward the atomization core 22 to supply oil to the atomization core 22. As shown in FIG. 1, the oil storage tank 20 is provided in the housing 10, and the oil storage tank 20 and the housing 10 may be provided integrally or separately. The breath detector 30 is used to sense whether or not gas flow is formed in the atomization channel 21 or the mist outlet pipeline 13, and belongs to a sensor. Therefore, the breath detector 30 is provided in the housing 10 to provide basic physical protection against collision by an external object.

In order to enable the breath detector 30 to indirectly reflect the presence of the gas flow in the atomization channel 21 or the mist outlet pipeline 13 by detecting the presence of the gas flow in the gas passage for the breath detector, the gas passage for the breath detector is formed in the housing 10. The suction part 11 is provided with a first gas hole 12 having an end exposed on the surface of the suction part 11, so that when the user keeps the suction part 11 in the mouth for suction, the negative pressure in the oral cavity of the user acts on both the mist outlet port of the mist outlet pipeline 13 and the first gas hole 12. An end of the first gas hole 12 away from the surface of the suction part 11 is connected to the gas passage for the breath detector so that when the first gas hole 12 is subjected to the negative pressure of the oral cavity of the user, the gas in the gas passage for the breath detector is driven to generate the gas flow. It can be seen that both the amount of gas flow in the mist outlet pipeline 13 and the atomization channel 21 and the amount of gas flow in the breath detector of the breath detector are affected by the amount of negative pressure in the oral cavity of the user. Therefore, the breath detector 30 only needs to detect the amount of gas flow in the gas passage for the breath detector to reflect the amount of gas flow in the mist outlet pipeline 13 or the atomization channel 21. The breath detector 30 is connected to the breath detector 30 so that the breath detector 30 can detect the amount of gas flow in the breath detector 30, thereby reflecting the amount of gas flow in the mist outlet pipeline 13 or the atomization channel 21. This is completely different from a general design of the breath detector. In the general design, the breath detector connects the breath detector to the mist outlet pipeline 13 directly through the hole in the side wall of the mist outlet pipeline 13 (or connects to the atomization channel 21 in the same way), without a separately designed first gas hole 12, so that the oil mist in the mist outlet pipeline 13 or the atomization channel 21 is likely to enter the gas passage for the breath detector, eventually coming into contact with the breath detector 30 and condensing oil on the surface of the breath detector 30, causing damage to the breath detector 30. According to one or more embodiments of the present disclosure, since an independent first gas hole 12 is designed, both the mist outlet pipeline 13 and the atomization channel 21 can be isolated from the gas passage for the breath detector, so that the mist does not enter the gas passage for the breath detector, thereby improving the protective effect for the breath detector 30. In practice, however, when the atomization device malfunctions or is in a relatively extreme environment (for example, under a low pressure on the aircraft), the oil in the oil storage tank 20 may break through the constraints of the oil guide cotton and the atomization core 22 and enter the atomization channel 21 or the mist outlet pipeline 13 directly in liquid form. In this way, in a general design of the gas passage for the breath detector, it is possible for the oil to enter the gas passage for the breath detector directly in liquid form and eventually damage the breath detector 30. However, according to one or more embodiments of the present disclosure, since a separate gas passage for the breath detector is designed, the gas passage for the breath detector also can be isolated from the oil storage tank 20, preventing damage to the breath detector 30 caused by the oil entering the gas passage for the breath detector in an extreme environment, and further improving the protective effect for the breath detector 30. In addition, in a general design of the gas passage for the breath detector, the generation of the gas flow in the breath detector always lags behind the generation of the gas flow in the mist outlet pipeline 13, since it is necessary to firstly form the gas flow in the mist outlet pipeline 13 to drive the gas in the gas passage for the breath detector to generate the gas flow. The first gas hole 12 is designed so that the gas passage for the breath detector is directly subjected to the negative pressure of the oral cavity of the user to form the gas flow, which enables the breath detector 30 to detect the presence of the gas flow more timely, so that the response speed of the atomization device to the suction action of the user is improved, further improving the sensitivity of the response of the breath detector.

Figure 2:
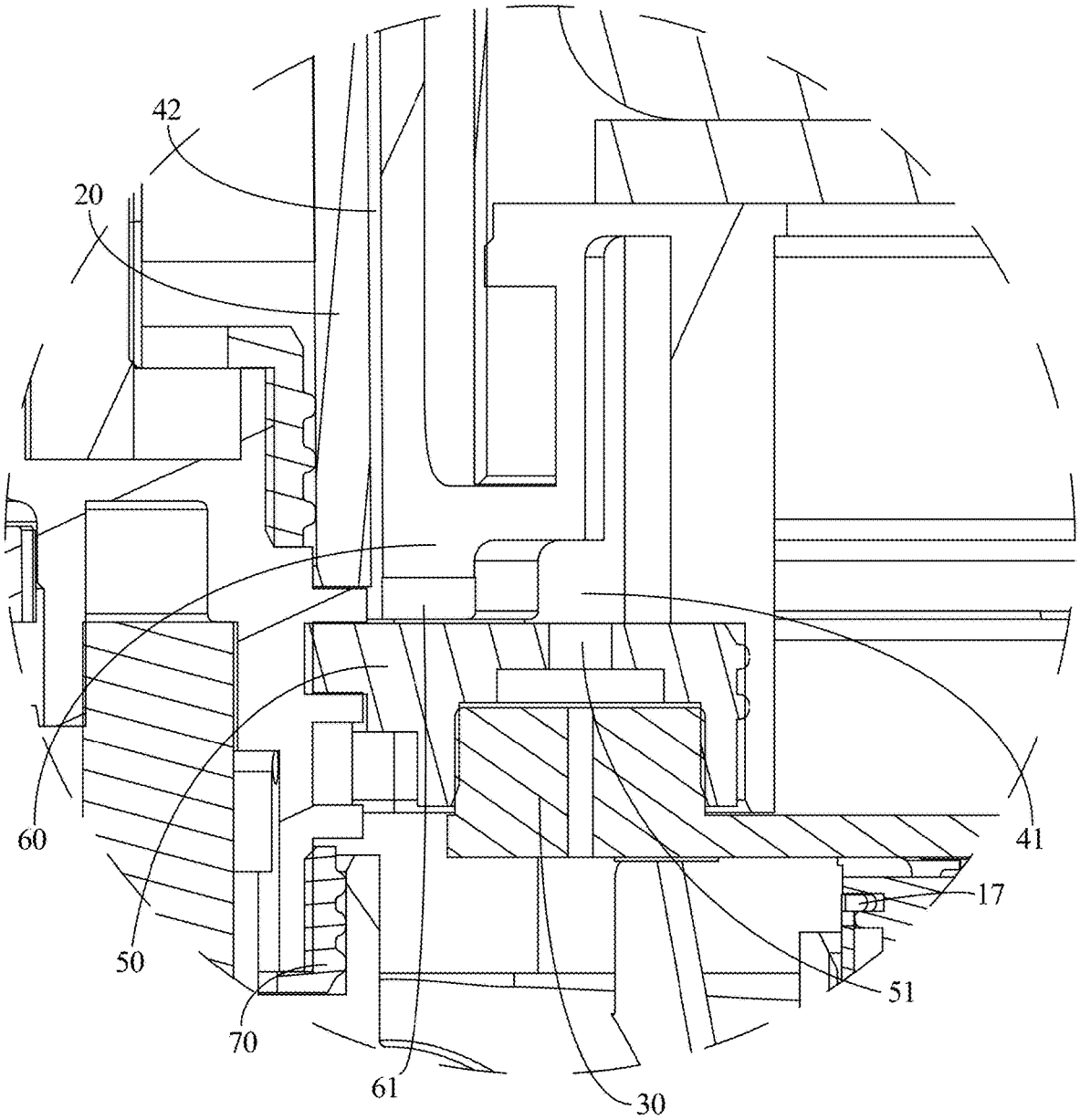
FIG. 2 is an enlarged view of part A in FIG. 1.
Figure 3:
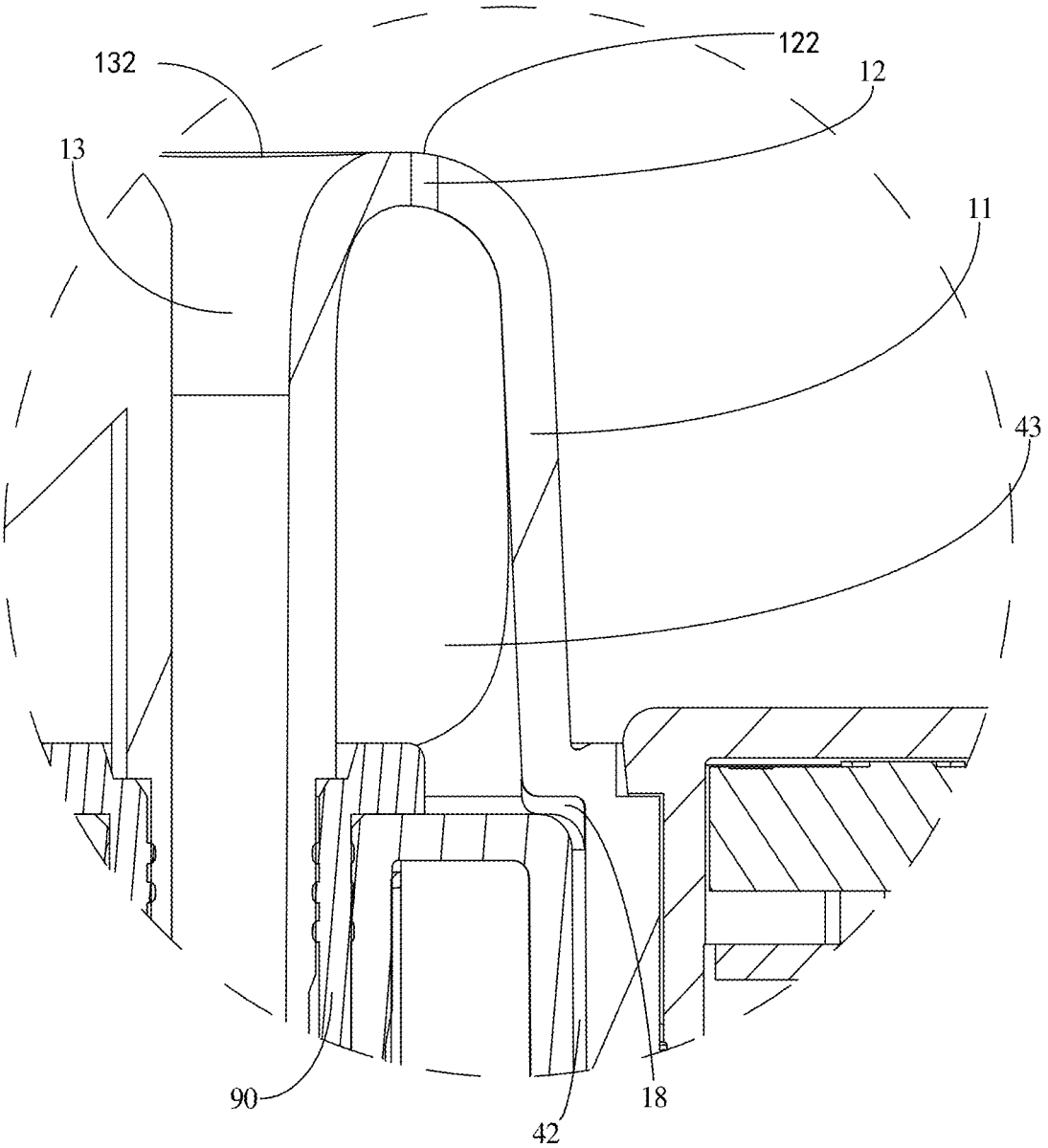
FIG. 3 is an enlarged view of part B in FIG. 1.

Referring to FIGS. 1, 2, and 3, in one or more embodiments of the present disclosure, the gas passage for the breath detector includes an upstream gas passage 41, a midstream gas passage 42, and a downstream gas passage 43 which are connected in sequence. The breath detector 30 is connected to the upstream gas passage 41. The first gas hole 12 is connected to the downstream gas passage 43. The midstream gas passage 42 is provided outside the oil storage tank 20 in a radial direction. As shown in FIG. 1, according to one or more embodiments of the present disclosure, the midstream gas passage 42 is formed by at least part of the gap between the outside of the oil storage tank 20 and the housing 10, and the gap between the outside of the oil storage tank 20 and the mounting wall 60, so that the midstream gas passage 42 can be formed directly by the existing structure in the atomization device, and no other structure is required, thereby reducing the manufacturing cost. However, the midstream gas passage 42 may be formed by providing a vent groove on the outside of the oil storage tank 20 and/or on the inside of the housing 10 and/or on the surface of the mounting wall 60. Alternatively, the midstream gas passage 42 may be formed by providing a hole in the oil storage tank 20 and/or the housing 10 and/or the mounting wall 60.

As shown in FIG. 6, according to one or more embodiments of the present disclosure, the direction of the gas flow in the gas passage for the breath detector and the direction of the gas flow in the atomization channel 21 can be seen. In FIG. 6, a solid arrow represents the flow direction in the gas passage for the breath detector, and a line arrow represents the flow direction in the atomization channel 21. As can be seen, during the atomization process, air enters the atomization channel 21 from the bottom of the housing 10, flows through the atomization core 22 in the atomization channel 21 to fuse the atomized smoke oil to form an aerosol, enters the mist outlet pipeline 13 from the mist outlet end 212 of the atomization channel 21 (i.e., the mist inlet end 131 and the mist outlet end 212 may be considered as the same end), and finally exits the atomization device for use by the user. In the gas passage for the breath detector, air enters the gas inlet side of the breath detector 30 from the second gas hole 17 in the charging socket 16, enters the upstream air path 41 after flowing through the breath detector 30, flows through the midstream air path 42, enters the downstream air path 43, and finally exits the atomization device through the first gas hole 12. In summary, the gas flow in the atomization channel 21 and the mist outlet pipeline 13 and the gas flow in the gas passage for the breath detector each have their own sources and outlets, so that the gas flow in the atomization channel 21 and the mist outlet pipeline 13 and the gas flow in the gas passage for the breath detector are isolated from each other completely, thereby preventing damage to the breath detector and other electronic devices caused by the atomized gas entering the breath detector entering the gas passage for the breath detector.

Figure 4:
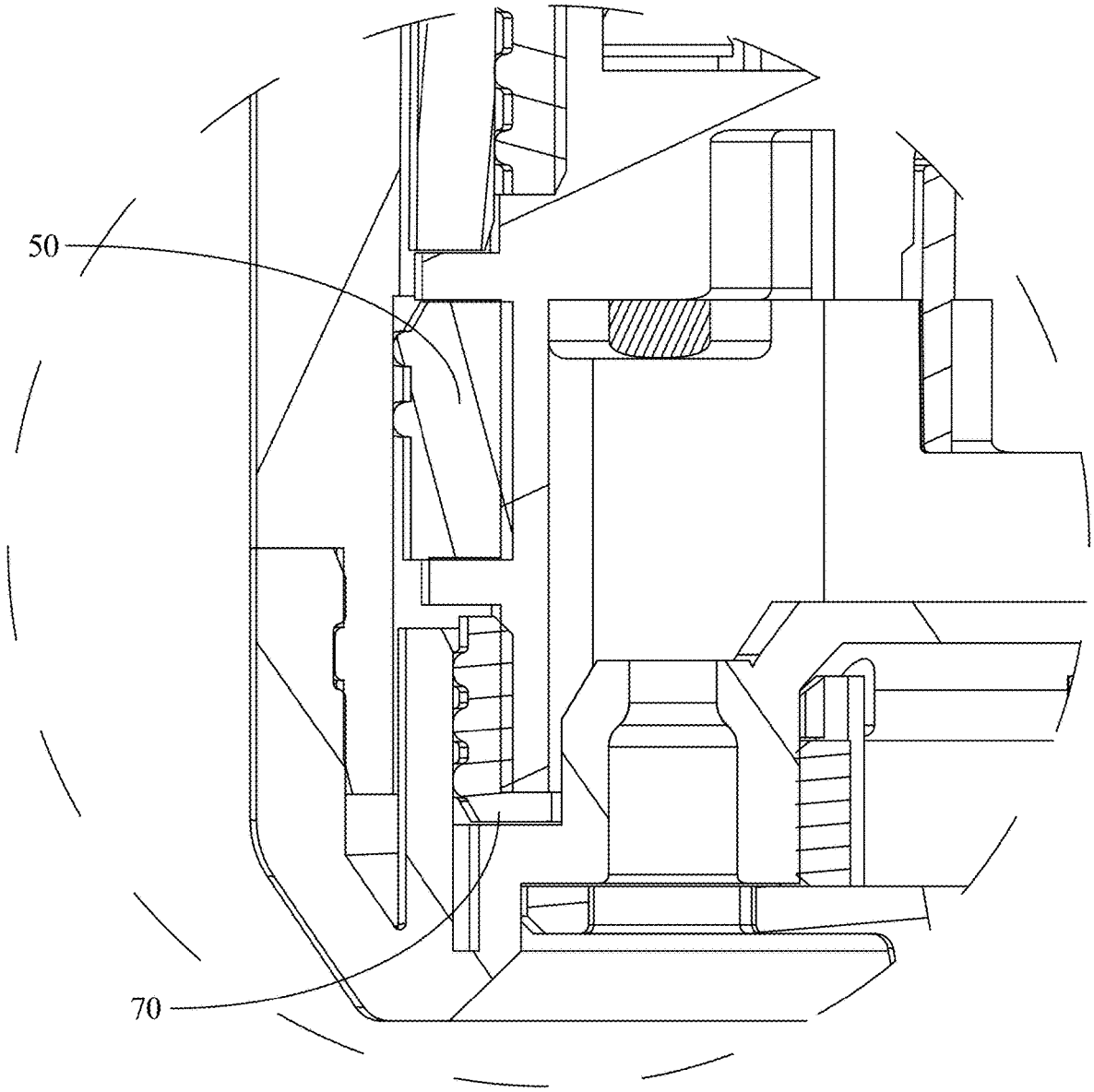
FIG. 4 is an enlarged view of part C in FIG. 1.

As shown in FIGS. 2, 4, and 6, in one or more embodiments of the present disclosure, the inlet end 421 of the midstream gas passage 42 is provided with a seal, and the seal is a first seal 50. A mounting wall 60 for providing mounting support is provided in the housing 10. The first seal 50 abuts against each of the housing 10 in the radial direction of the oil storage tank 20, and abuts against the mounting wall 60 in an axial direction of the oil storage tank, so that the gas passage for the breath detector can be closed as much as possible, thereby forming a stable gas passage volume, and preventing the accuracy in reflecting the actual gas flow of the breath detector 30 from being reduced by uncertain air leakage. The first seal 50 also covers the gas outlet side 302 of the breath detector 30. The side of the first seal 50 away from the breath detector 30 and the mounting wall 60 enclose the upstream gas passage 41, which also improves the sealing of the gas passage for the breath detector to improve the accuracy of the detection of the breath detector 30. The joint between the mounting wall 60 and the first seal 50 is provided with a first through hole 61 so that the first seal 50 and the upstream gas passage 41 is connected to the upstream gas passage 42, which prevents the inability of the breath detector 30 to detect a gas flow caused by accidental closure of the upstream gas passage 41 and the upstream gas passage 42 while ensuring the sealing. It should be noted that, in one or more embodiments, as shown in FIG. 2, the first through hole 61 is a hole formed by the enclosure of the mounting wall 60 and the first seal 50. However, the first through hole 61 may also be a hole independently formed in the mounting wall 60, and both embodiments are within the scope of the present disclosure. The first seal 50 is provided with a second through hole 51 so that the gas outlet side 302 of the breath detector 30 is connected to the upstream gas passage 41. The detection of the breath detector 30 requires the gas to flow through the breath detector 30. The second through hole 51 ensures that the gas outlet side of the breath detector 30 is open, so that the gas flow from the gas inlet side 301 of the breath detector 30 can smoothly enter the gas passage for the breath detector.

As shown in FIG. 3, in one or more embodiments, the downstream gas passage 43 is located within the suction part 11, and the suction part 11 and the mist outlet pipeline 13 enclose the downstream gas passage 43. The downstream gas passage 43 is connected to both the first gas hole 12 and the midstream gas passage 42. Generally, since the suction part 11 is required to be adapted to a bite shape comfortable to the user, it may be provided in a shape of a mouthpiece. However, in the axial direction of the mist outlet pipeline 13, the mist outlet pipeline 13 is required to be provided with a cross-sectional area less than that of the suction part 11 to ensure that a certain suction resistance and a negative pressure are generated, thereby facilitating the user to control the amount of the gas flow on the one hand, and facilitating the generation of the negative pressure to properly guide the oil in the oil storage tank 20 to the atomization core 22 on the other hand. Therefore, there is a large space between the suction part 11 and the mist outlet pipeline 13. By using this space to form the downstream gas passage 43, the structure of forming the downstream gas passage 43 can be simplified, thereby reducing the production cost. In addition, since the space between the suction part 11 and the mist outlet pipeline 13 is large, a buffer cavity can be formed, that is, when the negative pressure in the oral cavity of the user is large, a great pressure difference does not directly act on the breath detector 30 to cause damage to the breath detector 30, but reduces the pressure in the buffer cavity first, so that the pressure to which the breath detector 30 is subjected changes more smoothly, thereby improving the protection effect to the breath detector 30.

As shown in FIG. 3, in one or more embodiments, there is a gap between the housing 10 and the oil storage tank 20 to connect the downstream gas passage 43 and the midstream gas passage 42. As shown in FIG. 3, the gap may be formed by a through groove 18 provided in the housing 10. Similarly, a groove may be formed in the oil storage tank 20, and/or a through hole may be formed in the housing 10, and/or a through hole may be formed in the oil storage tank 20 to form the gap. The presence of the gap ensures the stability of the connection between the midstream gas passage 42 and the downstream gas passage 43 and prevents the isolation between the upstream gas passage and midstream gas passage 42 due to the change in the positional relationship between the oil storage tank 20 and the housing 10 during use of the atomization device.

As shown in FIGS. 2 and 4, in one or more embodiments, the mist inlet end of the atomization channel 21 is provided with a seal, and the seal is a second seal 70. The second seal 70 surrounds the mist inlet end of the atomization channel 21 and abuts against the housing 10 and the wall of the oil storage tank 20 for forming the mist inlet end of the atomization channel 21. The second seal 70 is provided so as to prevent mist from leaking from the fitting gap between the wall of the oil storage tank 20 for forming the inlet end of the atomization channel 21 and the housing 10, and prevent damage to other components caused by mist leaking to other parts of the atomization device (in particular, electronic devices such as a battery 80, a control main board, a display and the like).

As shown in FIG. 1, in one or more embodiments, the atomization device further includes a battery 80. An atomization chamber 14 and a battery chamber 15 which are spaced apart from each other are formed in the housing 10. The oil storage tank 20 is provided in the atomization chamber 14, and the battery 80 is provided in the battery chamber 15. The battery 80 is disposed at least partially spaced from the housing wall of the housing 10 for forming the battery chamber 15 in a radial direction to form the midstream gas passage 42. A buffer is often filled between the battery 80 and the housing 10 to prevent damage to the battery 80 caused by impact on the atomization device. Therefore, there may also be sufficient gap between the battery 80 and the housing 10 to form the midstream gas passage 42. According to one or more embodiments, an existing structure of the atomization device may also be utilized to form the midstream gas passage 42, thereby reducing manufacturing costs.

Figure 5:
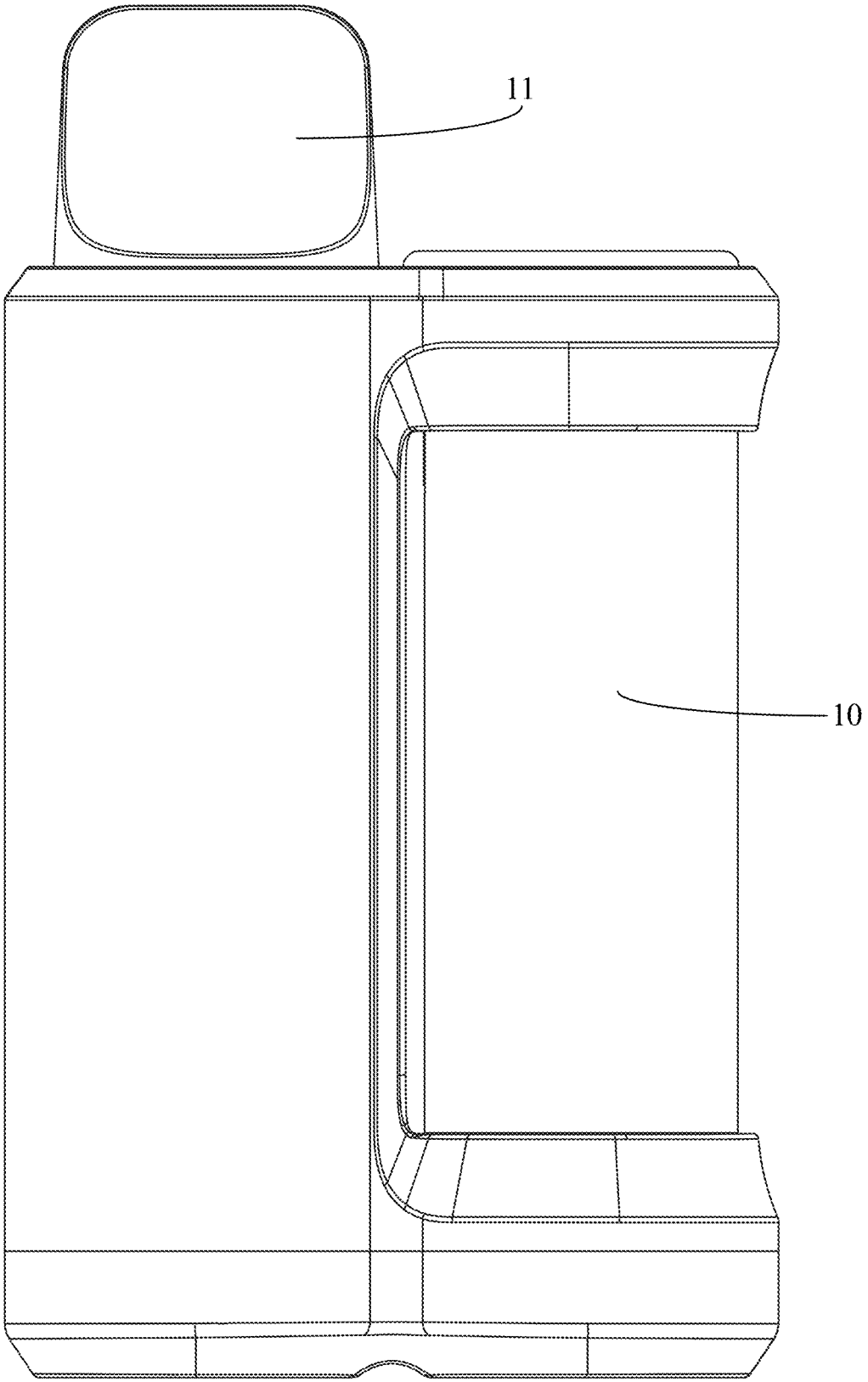
FIG. 5 is a schematic front view of an atomization device according to one or more embodiments of the present disclosure.

As shown in FIGS. 1 and 2, in one or more embodiments, a charging socket 16 is provided on the housing 10. a second gas hole 17 is provided in the wall of the housing 10 for forming the charging socket 16, and the second gas hole 17 is connected to the gas inlet side of the breath detector 30. As shown in FIG. 5, which is a schematic front view of an atomization device according to one or more embodiments of the present disclosure, it can be seen that the charging socket 16 is often recessed in the atomization device, so that it is difficult to see the wall of the housing 10 for forming the charging socket 16 from the appearance. This causes the second gas hole 17 to be hidden. In addition to improving the aesthetics of the atomization device, hiding the second gas hole 17 can prevent the second gas hole 17 from being accidentally blocked by external dirt, thereby ensuring that the gas passage for the breath detector is open, and further ensuring that the breath detector 30 can normally detect the gas flow.

As shown in FIG. 3, in one or more embodiments, the joint between the mist outlet pipeline 13 and the atomization channel 21 is provided with a seal, and the seal is a third seal 90. The third seal 90 abuts against both the mist outlet pipeline 13 and the atomization channel 21. The third seal 90 is provided so as to prevent mist from leaking from the fitting gap between the atomization channel 21 and the mist outlet pipeline 13, and prevent damage to other parts caused by mist leaking to other parts of the atomization device.

As shown in FIG. 3, in one or more embodiments, the mist outlet port 132 is disposed adjacent to the gas outlet 122 of the first gas hole 12. In this way, it is convenient for the user to keep both the gas outlet of the first gas hole 12 and the mist outlet port of the mist outlet pipeline 13 in the mouth, so as to act on both at the same time, thereby realizing the reflection of the gas flow in the mist outlet pipeline 13 by the breath detector 30.

According to the atomization device provided in one or more embodiments of the present disclosure, the atomization channel, the oil storage tank, and the mist outlet pipeline are all isolated from the gas passage for the breath detector, thereby improving the protection effect to the breath detector. The reason why the atomization channel and the mist outlet pipeline are completely isolated from the gas passage for the breath detector is because the suction part is provided with the first gas hole. When the user keeps the suction part in the mouth for suction, the negative pressure in the oral cavity acts on the mist outlet port of the mist outlet pipeline and the first gas hole at the same time, so that the gas flows in both the atomization channel and the gas passage for the breath detector. Thus, the gas flow in the gas passage for the breath detector does not depend on the gas flow in the mist outlet pipeline or the atomization channel, but forms a completely independent gas passage for the breath detector. Since the gas passage for the breath detector is completely isolated from the atomization channel and the mist outlet pipeline, mist in the atomization channel and the mist outlet pipeline does not reach the surface of the breath detector along the gas passage for the breath detector, so that oil is prevented from being condensed on the surface of the breath detector, and the protective effect of the breath detector is improved.

In the above-mentioned embodiments, the description of each embodiment has its own emphasis. For a part not described in detail in a certain embodiment, the related description of other embodiments may be referred to.

In the description of the present disclosure, the terms "first" and "second" are used for descriptive purposes only and are not to be construed as indicating or implying relative importance or implying the number of indicated technical features. Therefore, the features limited to "first" and "second" may explicitly or implicitly include one or more features.

Some embodiments of the present disclosure have been described in detail above. The description of the above embodiments merely aims to help to understand the present disclosure. Many modifications or equivalent substitutions with respect to the embodiments may occur to those of ordinary skill in the art based on the present disclosure. Thus, these modifications or equivalent substitutions shall fall within the scope of the present disclosure.

What is claimed is:

1. An atomization device, comprising:

a housing, comprising a suction part for suction by a user and a mist outlet pipeline provided in the suction part, the mist outlet pipeline having a mist outlet port exposed on a surface of the suction part;

an oil storage tank provided within the housing to store oil, wherein an atomization channel is formed within the oil storage tank and has a mist outlet end connected with a mist inlet end of the mist outlet pipeline; and a breath detector provided within the housing, wherein a first gas passage connected with the breath detector is formed within the housing;

the suction part is provided with a first gas hole having an end exposed on the surface of the suction part and an other end connected with the first gas passage; and each of the atomization channel, the oil storage tank and the mist outlet pipeline is isolated from the first gas passage.

2. The atomization device according to claim 1, wherein the first gas passage comprises an upstream gas passage, a midstream gas passage and a downstream gas passage connected in sequence;

the breath detector is connected with the upstream gas passage;

the first gas hole is connected with the downstream gas passage; and the midstream gas passage is formed on an outer side of the oil storage tank in a radial direction of the oil storage tank.

3. The atomization device according to claim 2, wherein a seal is provided at an inlet end of the midstream gas passage;

a mounting wall for providing mounting support is provided within the housing; and the seal abuts against the housing in the radial direction of the oil storage tank, and abuts against the mounting wall in an axial direction of the oil storage tank.

4. The atomization device according to claim 3, wherein the seal covers a gas outlet side of the breath detector; and a side of the seal away from the breath detector and the mounting wall enclose the upstream gas passage.

5. The atomization device according to claim 4, wherein a first through hole is provided at a joint between the mounting wall and the seal, so that each of the seal and the upstream gas passage is connected with the midstream gas passage.

6. The atomization device according to claim 5, wherein the seal is provided with a second through hole so that the gas outlet side of the breath detector is connected with the upstream gas passage.

7. The atomization device according to claim 3, wherein an outer side of the oil storage tank is at least partially spaced apart from each of the housing and the mounting wall to form the midstream gas passage.

8. The atomization device according to claim 2, wherein the downstream gas passage is located within the suction part; and the suction part and the mist outlet pipeline enclose the downstream gas passage.

9. The atomization device according to claim 8, wherein a gap is provided between the housing and the oil storage tank to connect the downstream gas passage with the midstream gas passage.

10. The atomization device according to claim 9, wherein the gap is formed by a through groove provided at the housing.

11. The atomization device according to claim 2, further comprising a battery, wherein an atomization chamber and a battery chamber are formed in the housing and spaced apart from each other;

the oil storage tank is disposed within the atomization chamber, and the battery is disposed in the battery chamber; and the battery and a wall of the housing for forming the battery chamber are at least partially spaced apart from each other in a radial direction of the battery to form the midstream gas passage.

12. The atomization device according to claim 1, wherein a seal is provided to surround a mist inlet end of the atomization channel, and abuts against each of the housing and a wall of the oil storage tank for forming the mist inlet end of the atomization channel.

13. The atomization device according to claim 1, wherein the housing is provided with a charging socket; and a wall of the housing for forming the charging socket is provided with a second gas hole connected with a gas inlet side of the breath detector.

14. The atomization device according to claim 1, wherein a seal is provided at the mist inlet end of the mist outlet pipeline, and abuts against each of the mist outlet pipeline and a wall of the oil storage tank for forming the mist outlet end of the atomization channel.

15. The atomization device according to claim 1, wherein the mist outlet port is adjacent to a gas outlet of the first gas hole.

16. The atomization device according to claim 1, wherein in an axial direction the mist outlet pipeline has a cross-sectional area less than the suction part.

* * * * *